US011536499B2

(12) United States Patent
Maeta et al.

(10) Patent No.: US 11,536,499 B2
(45) Date of Patent: Dec. 27, 2022

(54) REFRIGERATION MACHINE

(71) Applicant: MITSUBISHI HEAVY INDUSTRIES THERMAL SYSTEMS, LTD., Tokyo (JP)

(72) Inventors: Koji Maeta, Tokyo (JP); Shintaro Omura, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 162 days.

(21) Appl. No.: 16/760,262

(22) PCT Filed: Oct. 10, 2018

(86) PCT No.: PCT/JP2018/037718

§ 371 (c)(1),
(2) Date: Apr. 29, 2020

(87) PCT Pub. No.: WO2019/093050

PCT Pub. Date: May 16, 2019

(65) Prior Publication Data

US 2020/0355422 A1 Nov. 12, 2020

(30) Foreign Application Priority Data

Nov. 8, 2017 (JP) ..... JP2017-215427

(51) Int. Cl.
*F25D 23/00* (2006.01)
*F25B 41/40* (2021.01)
(Continued)

(52) U.S. Cl.
CPC ..... *F25B 41/39* (2021.01); *F25B 13/00* (2013.01); *F25B 41/40* (2021.01); *F25D 23/00* (2013.01); *F25D 2500/00* (2013.01)

(58) Field of Classification Search
CPC .. F25D 23/00; F25D 2201/00; F25D 2201/30; F25D 2500/00; F25B 13/00; F25B 2500/12; F25B 2500/13
See application file for complete search history.

(56) References Cited

U.S. PATENT DOCUMENTS 11,073,145 B2 * 7/2021 Wang ..... F16L 55/05
2002/0035844 A1 3/2002 Lee et al.
(Continued)

FOREIGN PATENT DOCUMENTS

CN 2526750 Y 12/2002
CN 101501420 A 8/2009
(Continued)

OTHER PUBLICATIONS

English Translation of Yoshiro et al. (JP 59-56312 U) (Year: 1984).*
(Continued)

*Primary Examiner* — Miguel A Diaz
(74) *Attorney, Agent, or Firm* — Birch, Stewart, Kolasch & Birch, LLP

(57) ABSTRACT

Provided is a refrigeration machine provided with: a refrigeration cycle having a compressor, a condenser, an expander, an evaporator, and piping (12) which sequentially connects the compressor, the condenser, and the expander; and an acoustic device (13) having a space formation section (14) which has one end (14*a*) connected to the piping (12) and in which a space is formed, the acoustic device (13) also having a vibration body (20) which is affixed integrally to the other end of the space formation section (14) and which has a lower natural frequency than the space formation section (14).

4 Claims, 4 Drawing Sheets

(51) Int. Cl.
*F25B 41/39* (2021.01)
*F25B 13/00* (2006.01)

(56) References Cited

U.S. PATENT DOCUMENTS

| | | | | |
|---|---|---|---|---|
| 2005/0194207 | A1* | 9/2005 | Nemit | F02M 35/1222 181/250 |
| 2006/0065479 | A1* | 3/2006 | Okawa | F02M 35/1266 181/276 |
| 2010/0175409 | A1 | 7/2010 | Ishikawa et al. | |
| 2020/0348057 | A1* | 11/2020 | Maeta | F16L 55/02709 |

FOREIGN PATENT DOCUMENTS

| | | | |
|---|---|---|---|
| EP | 2058609 | A1 | 5/2009 |
| JP | 59-56312 | U | 4/1984 |
| JP | A-61-66686 | U | 5/1986 |
| JP | 1-113692 | U | 7/1989 |
| JP | 4-262015 | A | 9/1992 |
| JP | 2002-106464 | A | 4/2002 |
| JP | 2002-327700 | A | 11/2002 |
| JP | 2003-186479 | A | 7/2003 |
| JP | 2004-36778 | A | 2/2004 |
| JP | 2008-45778 | A | 2/2008 |

OTHER PUBLICATIONS

Chinese Office Action issued in the counterpart Chinese Application No. 201880070482.4, dated Mar. 26, 2021 with an English machine translation thereof.
International Search Report for International Application No. PCT/JP2018/037718, dated Dec. 18, 2018, with English translation.
Written Opinion of the International Searching Authority for International Application No. PCT/JP2018/037718, dated Dec. 18, 2018, with English translation.

* cited by examiner

REFRIGERATION MACHINE

TECHNICAL FIELD

The present invention relates to a chiller.

This application claims the priority of Japanese Patent Application No. 2017-215427 filed in Japan on Nov. 8, 2017, the contents of which are incorporated herein by reference.

BACKGROUND ART

A chiller is a heat source machine that is used widely for applications such as air conditioning of a factory having a clean room such as an electrical and electronic factory, and district cooling and heating. As the chiller, a refrigerator is known in which the components such as a centrifugal compressor, a condenser, and an evaporator are arranged in the vicinity and integrated into a unit (for example, see PTL 1).

CITATION LIST

Patent Literature

[PTL 1] Japanese Unexamined Patent Application Publication No. 2002-327700

SUMMARY OF INVENTION

Technical Problem

An increase in noise generated from the chiller has been a problem with an increase in the efficiency of the chiller. The causes of noise generated from the chiller are classified into two types of noise due to mechanical causes and noise due to fluid causes.

The noise due to the mechanical causes is generated by periodic flow fluctuations due to the movement of the blades and the number of diffuser blades generated when the centrifugal compressor or a pump operates. The periodic flow fluctuations cause a pressure pulsation, whereby noise called NZ sound is generated.

The noise due to the mechanical causes has a property of a specific and single frequency characteristic. It has been known that noise due to the mechanical causes resonates with an acoustic eigenvalue of a pipe or the like inside the chiller and the sound is amplified.

An object of the invention is to provide a chiller that includes a refrigeration cycle including a compressor, a condenser, an expander, an evaporator, and a pipe that sequentially connects the compressor, the condenser, the expander, and the evaporator, and is capable of suppressing noise.

Solution to Problem

An aspect of the invention relates to a chiller including a refrigeration cycle including a compressor, a condenser, an expander, an evaporator, a pipe that sequentially connects the compressor, the condenser, the expander, and evaporator and a discharge pipe, and an acoustic device including a space formation section that has one end connected to the pipe and in which a space is formed, and a vibration body that is fixed integrally to the other end of the space formation section and has a lower natural frequency than the space formation section.

According to the configuration, by attaching the acoustic device to the pipe, it is possible to reduce noise due to resonance of an acoustic eigenvalue of the space in the pipe with NZ sound of at least one component of the compressor, the condenser, the expander, the evaporator, and the pipe that configure the chiller. Also, the acoustic device includes the vibration body having a small natural frequency, and the vibration body converts acoustic energy into structural vibration energy, whereby it is possible to reduce the size of the acoustic device.

In the chiller, the acoustic device may include a porous plate disposed at a boundary between the one end of the space formation section and a flow path of the pipe.

According to the configuration, by adjusting the acoustic impedance of at least one component of the compressor, the condenser, the expander, the evaporator, and the pipe that configure the chiller, whereby it is possible to suppress generation of the acoustic impedance of a specific frequency, which may resonate with the noise.

In the chiller, the space formation section may include a cylindrical main body section and a lid section provided in the other end of the main body section, and the vibration body may be fixed integrally to the lid section.

According to the configuration, it is possible to adjust the acoustic impedance by adjusting a length of the main body section and an opening ratio of the porous plate.

In the chiller, the space formation section may include a cylindrical tubular section that forms the one end of the space formation section, and a container section that is connected to the other end of the tubular section and has a volume larger than a volume of the tubular section, an internal space of the tubular section and an internal space of the container section may communicate with each other, and the vibration body may be fixed integrally to the container section.

According to the configuration, by adjusting the volume of the container section of the acoustic device, it is possible to adjust the acoustic impedance of at least one component of the compressor, the condenser, the expander, the evaporator, and the pipe that configure the chiller.

Advantageous Effects of Invention

According to the invention, by attaching the acoustic device to the pipe, it is possible to reduce noise due to resonance of an acoustic eigenvalue of the space in the pipe with the NZ sound of at least one component of the compressor, the condenser, the expander, the evaporator, and the pipe that configure the chiller. Also, the acoustic device includes the vibration body having a small natural frequency, and the vibration body converts acoustic energy into structural vibration energy, whereby it is possible to reduce the size of the acoustic device.

DESCRIPTION OF EMBODIMENTS

First Embodiment

Hereinafter, a chiller according to a first embodiment of the invention will be described in detail with reference to the drawings.

Figure 1:
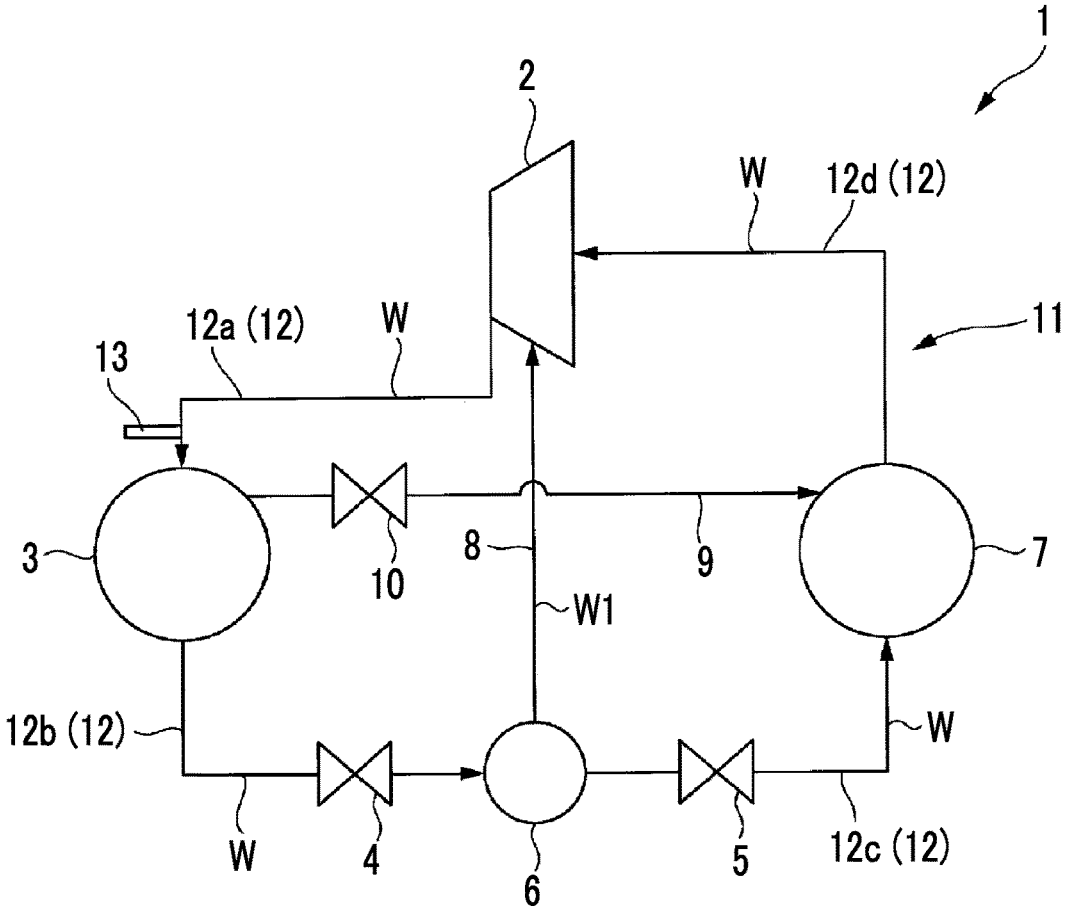
FIG. 1 is a schematic configuration view of a chiller according to a first embodiment of the invention.

As shown in FIG. 1, a chiller 1 of the present embodiment includes a compressor 2 that compresses a refrigerant W, a condenser 3 that condenses the refrigerant W compressed by the compressor 2 by cooling water, a first expansion valve 4 that is an expander depressurizing the refrigerant W from the condenser 3, and an economizer 6 (a gas-liquid separator) that separates the refrigerant W from the first expansion valve 4 into two phases of gas and liquid.

Also, the chiller 1 includes an inflow path 8 that allows a gas phase W1 from the economizer 6 to flow into the compressor 2, a second expansion valve 5 that depressurizes a liquid phase from the economizer 6 again, and an evaporator 7 that evaporates the refrigerant W from the second expansion valve 5.

A hot gas bypass pipe 9 is provided between a gas phase section of the condenser 3 and a gas phase section of the evaporator 7. The hot gas bypass pipe 9 is provided with a hot gas bypass valve 10 for controlling a flow rate of a high-temperature refrigerant gas flowing in the hot gas bypass pipe 9.

The chiller 1 includes a refrigeration cycle 11 including a pipe 12. The pipe 12 sequentially connects the compressor 2, the condenser 3, the first expansion valve 4, the second expansion valve 5, and the evaporator 7. Specifically, the chiller 1 includes a pipe 12*a* that connects the compressor 2 and the condenser 3, a pipe 12*b* that connects the condenser 3 and the economizer 6, a pipe 12*c* that connects the economizer 6 and the evaporator 7, and a pipe 12*d* that connects the evaporator 7 and the compressor 2. The pipe 12 is a flow path through which the refrigerant W flows. The refrigerant W is, for example, R134a of alternative chlorofluorocarbon (hydrofluorocarbons).

An acoustic device 13 that reduces noise generated in the compressor 2 is provided in the pipe 12*a* that connects the compressor 2 and the condenser 3.

The compressor 2 is a centrifugal two-stage compressor, and is driven by an electric motor (not shown) of which a rotation speed is controlled by an inverter that changes input frequency from a power supply.

The condenser 3 is a device that cools the refrigerant W compressed by the compressor 2 by exchanging heat with cooling water and makes the refrigerant W to be in a liquid state. The condenser 3 is, for example, a shell and tube type heat exchanger.

The first expansion valve 4 is an expander that adiabatically expands and depressurizes the liquid refrigerant W from the condenser 3, evaporates a part of the liquid, and makes the refrigerant W into two phases of gas and liquid.

The economizer 6 is a device that separates the refrigerant W in a state of two phases of gas and liquid in the first expansion valve 4 into the gas phase W1 and the liquid phase.

The inflow path 8 is a flow path through which the gas phase W1 separated from the refrigerant W of two phases of gas and liquid by the economizer 6 flows into the compressor 2.

The second expansion valve 5 is an expander that adiabatically expands and depressurizes the refrigerant W in which the gas phase W1 is separated by the economizer 6 and only the liquid phase is present, similar to the first expansion valve 4. In the chiller 1 according to the present embodiment, the refrigerant W is depressurized by using the expansion valve, but the configuration is not limited thereto, and the refrigerant W may be depressurized by using other means.

The evaporator 7 evaporates the refrigerant W from the second expansion valve 5 by exchanging heat with water and makes the refrigerant W to be in a saturated vapor state.

Figure 2:
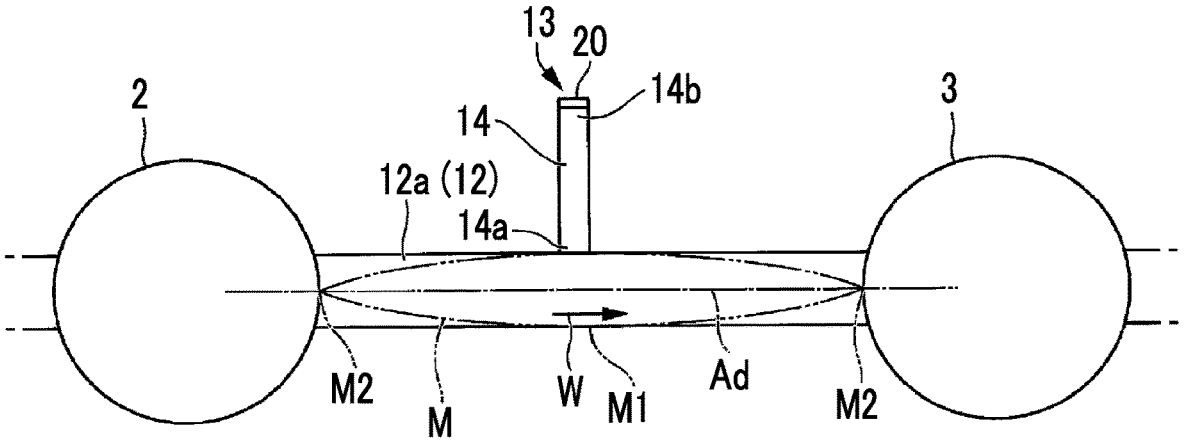
FIG. 2 is a schematic configuration view of a compressor, a condenser, and a pipe that connects the compressor, and the condenser of the chiller according to the first embodiment of the invention.

As shown in FIG. 2, the acoustic device 13 is a silencer provided in the pipe 12*a* that connects the compressor 2 and the condenser 3. The acoustic device 13 includes a space formation section 14 that has one end 14*a* connected to the pipe 12*a* and in which a space is formed, and a vibration body 20 (an acoustic material) that is fixed integrally to the other end 14*b* of the space formation section 14.

When the compressor 2 operates, the periodic flow fluctuation is generated due to the rotation of the impeller or the number of diffuser blades. The periodic flow fluctuations cause a pressure pulsation, whereby noise called NZ sound is generated.

The NZ sound generated due to the mechanical causes has a property of a specific and single frequency characteristic, and may resonate with the acoustic impedance of the pipe 12 of the chiller 1. That is, it is known that the NZ sound is in an acoustic mode M as indicated by a two-dot chain line in FIG. 2 and is amplified.

The acoustic mode M has an antinode M1 and a node M2.

The antinode M1 is a position where the acoustic energy (amplitude) is maximum, and the node M2 is a position where the acoustic energy (amplitude) is substantially zero.

The acoustic device 13 is attached to the position of the antinode M1 of the acoustic mode M. Stated another way, the acoustic device 13 is attached to the position where the acoustic energy of sound generated in the pipe 12 is maximum.

Figure 3:
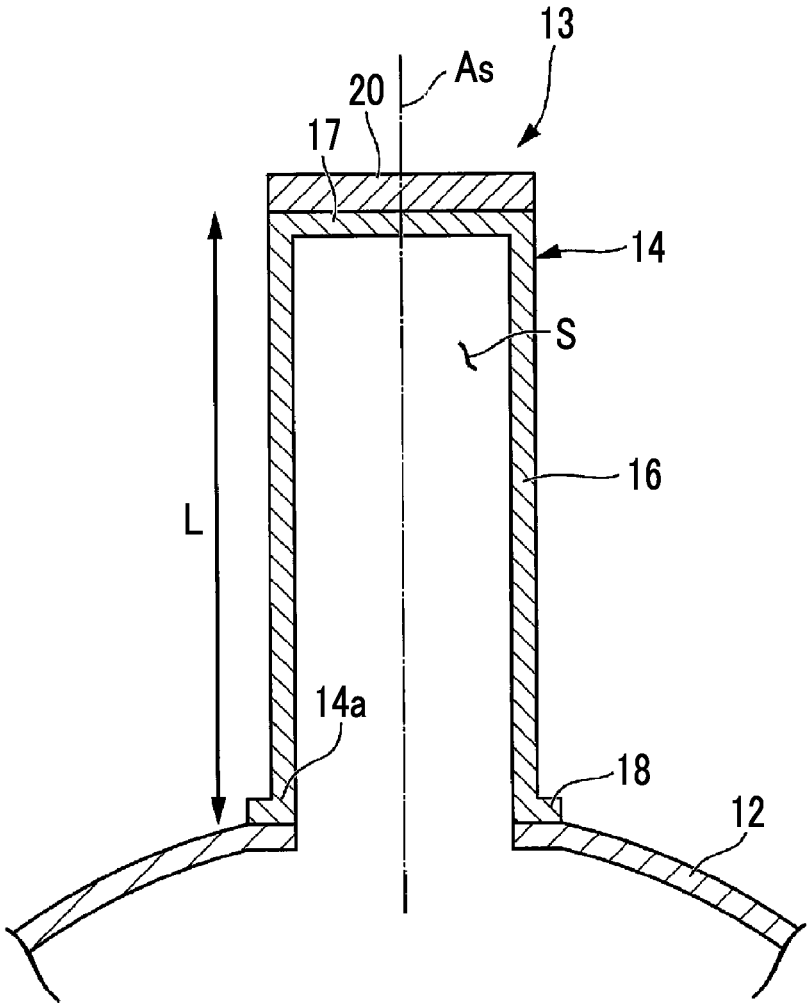
FIG. 3 is a cross-sectional view of an acoustic device of the chiller according to the first embodiment of the invention.

As shown in FIG. 3, the space formation section 14 has a bottomed cylindrical shape, and the inside thereof is a resonance space S that reduces sound by the interference of a sound wave.

The space formation section 14 includes a cylindrical acoustic device main body section 16, and a plate-shaped lid section 17 provided in the other end of the acoustic device main body section 16. The shape of the acoustic device main body section 16 is not limited thereto, and may be a rectangular tube shape. A center axis As of the acoustic device 13 is substantially orthogonal to a center axis Ad (see FIG. 2) of the pipe 12.

A flange section 18 is formed in one end 14*a* of the acoustic device main body section 16 so as to project in a radial direction of the center axis As of the acoustic device main body section 16. The acoustic device 13 is fixed to the pipe 12 via the flange section 18.

The space formation section 14 is, for example, formed of stainless steel such as SUS316. The material forming the space formation section 14 is not limited to SUS316, and a predetermined metal can be appropriately selected.

The vibration body 20 is a plate-shaped member having substantially the same shape as the lid section 17 of the space formation section 14. The vibration body 20 is fixed such that a main surface of the vibration body 20 and a main surface of the lid section 17 are in surface contact.

The vibration body 20 is fixed to the lid section 17 of the space formation section 14 by, for example, welding. The method of fixing the vibration body 20 is not limited to welding, and for example, a fastening member such as a screw may be used. The vibration body 20 may be fixed by using an adhesive.

The vibration body 20 is formed to have a lower natural frequency than the space formation section 14. Stated another way, the vibration body 20 converts the acoustic energy transmitted by the pipe 12 into the structural vibration energy more easily than the space formation section 14. The vibration body 20 has a structure that is light, soft, and in which vibration increases.

The vibration body 20 is, for example, formed of a metal, such as a magnesium alloy, having a lower Young's modulus and a lower density than a metal (SUS316) forming the space formation section 14.

In the above embodiment, the metal forming the vibration body 20 is a magnesium alloy, but the metal is not limited thereto. For example, a metal, such as aluminum, having a lower Young's modulus and a lower density than the metal forming the space formation section 14 may be used.

That is, the natural frequency of the acoustic device 13 can be adjusted by the vibration body 20. Parameters for adjusting the natural frequency of the acoustic device 13 are as follows:

(1) a Young's modulus E of the vibration body 20;

(2) a density p of the vibration body 20; and (3) a thickness t of the vibration body 20.

The shape of the vibration body 20 is not limited to a plate shape, and may be, for example, a column shape.

The vibration body may be formed by a hollow member.

According to the embodiment, by attaching the acoustic device 13 to the pipe 12, it is possible to reduce noise due to resonance of the acoustic eigenvalue of the space in the pipe 12 with the NZ sound of the compressor 2 configuring the chiller 1. Also, the acoustic device 13 includes the vibration body 20 having the small natural frequency, and the vibration body converts the acoustic energy into the structural vibration energy, whereby it is possible to reduce the size of the acoustic device 13.

The natural frequency of the acoustic device 13 can be changed by replacing the vibration body 20.

The acoustic device 13 is connected to the pipe 12 via the flange section 18, whereby the acoustic device 13 can be easily replaced and maintained.

In the above embodiment, the acoustic device 13 is installed in the pipe 12*a* between the compressor 2 and the condenser 3, but the configuration is not limited thereto. For example, the acoustic device 13 may be disposed in the pipe 12*b* and 12*c* between the condenser 3 and the evaporator 7, the pipe 12*d* between the evaporator 7 and the compressor 2, or the hot gas bypass pipe 9.

Also, the acoustic device 13 may be disposed in a discharge pipe through which an unnecessary fluid is discharged.

The number of acoustic devices 13 is not limited to one. The acoustic device 13 can be attached to at least one of the components (the compressor 2, the condenser 3, the expander 4 and 5, the evaporator 7, and the pipe 12) that configure the refrigeration cycle 11. For example, the acoustic devices 13 may be attached to all the pipes 12, or two acoustic devices 13 may be attached to one pipe 12.

Second Embodiment

Hereinafter, a chiller according to a second embodiment of the invention will be described in detail with reference to the drawings. In the present embodiment, differences from the first embodiment will be mainly described, and the description of the same parts will be omitted.

Figure 4:
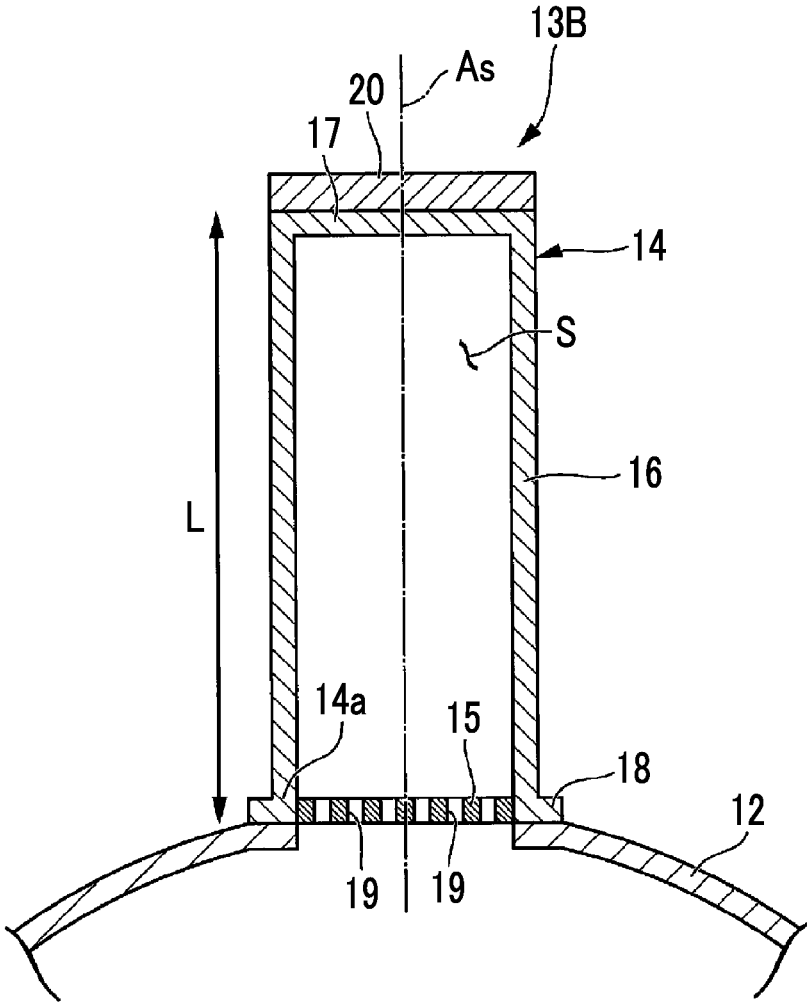
FIG. 4 is a cross-sectional view of an acoustic device of a chiller according to a second embodiment of the invention.

As shown in FIG. 4, an acoustic device 13B according to the present embodiment includes a porous plate 15 disposed at a boundary between the one end 14*a* of the space formation section 14 and a flow path of the pipe 12.

The porous plate 15 is for suppressing air turbulence at the one end 14*a* of the space formation section 14.

The porous plate 15 is provided at the one end 14*a* of the space formation section 14. A main surface of the porous plate 15 is substantially orthogonal to the center axis As of the acoustic device main body section 16. A plurality of circular through-holes 19 are regularly arranged in the porous plate 15. The shape of the through-hole 19 is not limited to a circle, and may be a rectangular or a slit shape.

In the chiller 1 according to the present embodiment, a length L (see FIG. 4) of the acoustic device 13, a pore diameter $\phi$ of the through-hole 19 of the porous plate 15, and an opening ratio $\sigma$ (a ratio of area of through-hole 19 per area of the porous plate 15) of the porous plate 15 are adjusted to make the boundary between the pipe 12 and the condenser 3 to be $Z=\rho c$ boundary.

The $Z=\rho c$ boundary is a boundary in which an acoustic impedance Z at the boundary is matched to make the reflection of sound non-reflective by using the parameter expressed by the acoustic impedance z as the density $\rho$ and a sound velocity c.

According to the above embodiment, it is possible to suppress generation of the acoustic impedance of a specific frequency of the pipe 12, which may resonate with the NZ sound of the compressor 2 configuring the chiller 1. Therefore, it is possible to reduce the noise level.

The acoustic impedance of the pipe 12 can be adjusted by adjusting the length L of the acoustic device (the acoustic device main body section 16), the pore diameter $\phi$ of the through-hole 19 of the porous plate 15, and the opening ratio $\sigma$ of the porous plate 15.

Third Embodiment

Hereinafter, a chiller according to a third embodiment of the invention will be described in detail with reference to the drawings. In the present embodiment, differences from the first embodiment will be mainly described, and the description of the same parts will be omitted.

Figure 5:
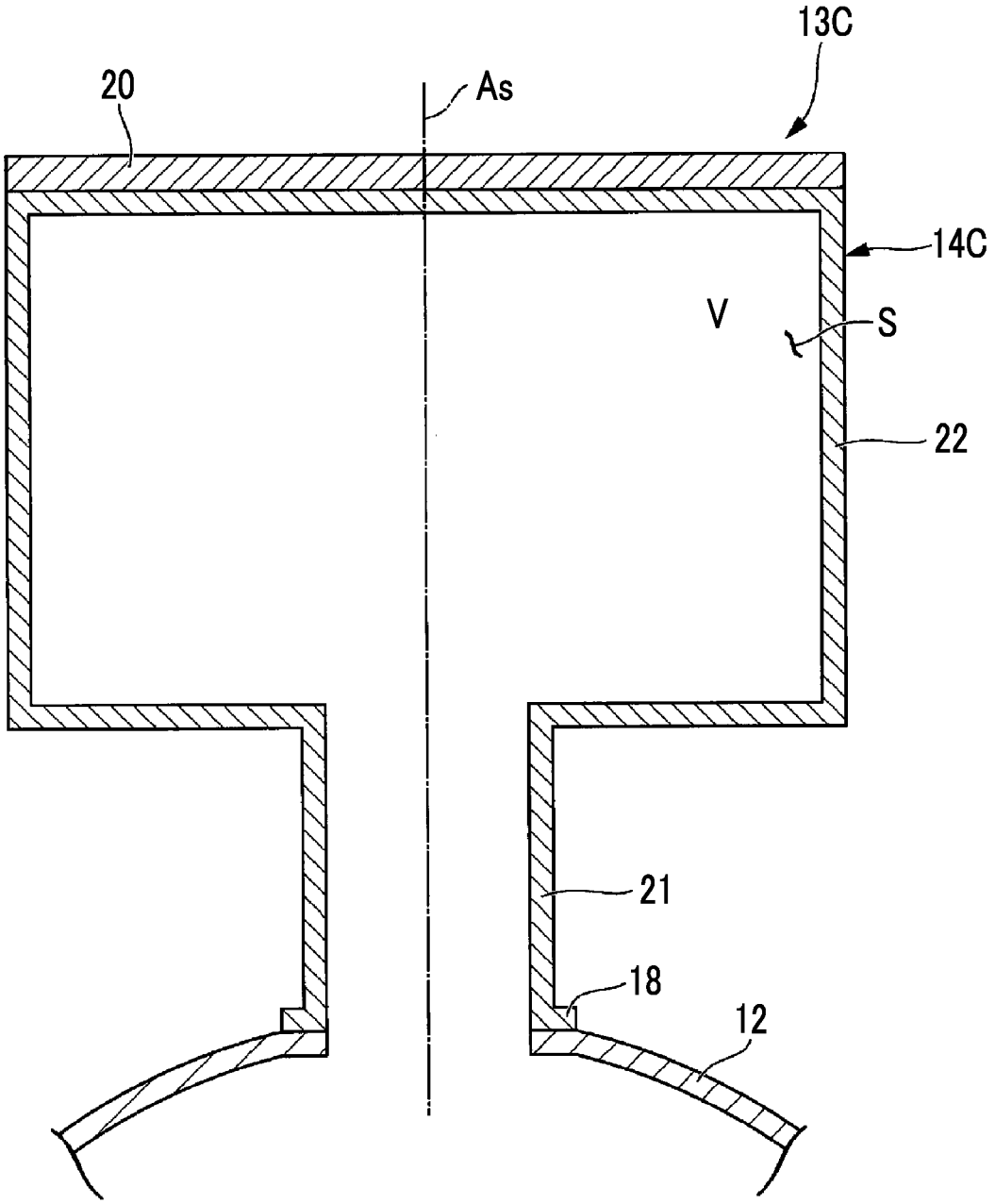
FIG. 5 is a cross-sectional view of an acoustic device of a chiller according to a third embodiment of the invention.

As shown in FIG. 5, the shape of the space formation section 14 of an acoustic device 13C according to the third embodiment is different from the shape of the space formation section of the acoustic device 13 according to the first embodiment. The space formation section 14C according to the present embodiment includes a tubular section 21 forming the one end (an end connected to the pipe 12) of the space formation section 14C, and the container section 22 that is connected to the other end of the tubular section 21 and has the volume larger than the volume of the tubular section 21.

The acoustic device 13C according to the present embodiment functions as a Helmholtz resonator in which air inside the container section 22 serves as a spring.

The tubular section 21 has a cylindrical shape. The shape of the tubular section 21 is not limited to the cylindrical shape, and may be a rectangular cylindrical shape.

The container section 22 has a barrel shape having a diameter larger than a diameter of the tubular section 21. The shape of the container section 22 is not limited thereto, and need only have the volume larger than the volume of the tubular section 21. For example, the container section 22 may have a spherical shape. The internal space of the tubular section 21 and the internal space of the container section 22 communicate with each other.

According to the above embodiment, the volume V of the container section 22 of the acoustic device 13B can be adjusted, whereby the acoustic impedance of the pipe 12 can be adjusted.

The embodiments of the invention are described in detail with reference to the drawings, however, the specific configuration is not limited to the above embodiments, and includes a design change or the like without departing from the scope of the invention.

INDUSTRIAL APPLICABILITY

According to the invention, by attaching the acoustic device to the pipe, it is possible to reduce noise due to resonance of an acoustic eigenvalue of the space in the pipe with the NZ sound of at least one component of the compressor, the condenser, the expander, the evaporator, and the pipe that configure the chiller. Also, the acoustic device includes the vibration body having a small natural frequency, and the vibration body converts acoustic energy into structural vibration energy, whereby it is possible to reduce the size of the acoustic device.

REFERENCE SIGNS LIST

1: chiller
2: compressor
3: condenser
4: first expansion valve
5: second expansion valve
6: economizer
7: evaporator
8: inflow path
9: hot gas bypass pipe
10: hot gas bypass valve
11: refrigeration cycle
12: pipe
13, 13B: acoustic device
14, 14B: space formation section
14*a*: one end
14*b*: the other end
15: porous plate
16: acoustic device main body section (main body section)
17: lid section
18: flange section
19: through-hole
20: vibration body
21: tubular section
22: container section
S: resonance space
W: refrigerant

The invention claimed is:

1. A chiller comprising:

a refrigeration cycle including a compressor, a condenser, an expander, an evaporator, a pipe that sequentially connects the compressor, the condenser, the expander, and the evaporator, and a discharge pipe; and an acoustic device including a space formation section that has a first end and a second end, the first end of the space formation section connected to the pipe and in which a space is formed, and a vibration body that is fixed integrally to the second end of the space formation section and has a lower natural frequency than the space formation section, wherein the space formation section includes a cylindrical main body section provided at the first end of the space formation section and a lid section provided at the second end of the space formation section, wherein the vibration body is fixed integrally to the lid section, wherein the vibration body is fixed such that a main surface of the vibration body and a main surface of the lid section are in surface contact, wherein the vibration body and the space formation section are each formed of metal, and wherein the metal forming the vibration body has a lower Young's modulus than the metal forming the space formation section, and the metal forming the vibration body has a lower density than the metal forming the space formation section.

2. The chiller according to claim 1, wherein the space formation section includes a cylindrical tubular section and a container section, wherein the tubular section forms a first end and a second end, wherein the first end of the tubular section is connected to the pipe, wherein the container section is connected to the second end of the tubular section and has a volume larger than a volume of the tubular section, wherein an internal space of the tubular section and an internal space of the container section communicate with each other, and wherein the vibration body is fixed integrally to the second end of the space formation section.

3. The chiller according to claim 1, wherein the acoustic device includes a porous plate disposed at a boundary between the first end of the space formation section and a flow path of the pipe.

4. The chiller according to claim 3, wherein the space formation section includes a cylindrical tubular section and a container section, wherein the tubular section forms a first end and a second end, wherein the first end of the tubular section is connected to the pipe, wherein the container section is connected to the second end of the tubular section and has a volume larger than a volume of the tubular section, wherein an internal space of the tubular section and an internal space of the container section communicate with each other, and wherein the vibration body is fixed integrally to the second end of the space formation section.

* * * * *